United States Patent [19]

Boris

[11] 3,940,070

[45] Feb. 24, 1976

[54] ATOMISER HAVING A PLUNGER TUBE

[75] Inventor: Michel Boris, Paris, France

[73] Assignee: Societe Technique de Pulverisation, Paris, France

[22] Filed: Aug. 16, 1974

[21] Appl. No.: 498,068

[30] Foreign Application Priority Data

Aug. 16, 1973 France ..... 73.30656

[52] U.S. Cl. ..... 239/333; 222/385

[51] Int. Cl.[2] ..... B05B 9/043

[58] Field of Search ..... 222/321, 384, 385, 383; 417/474, 550; 239/329, 331, 333, 350, 355–361, 579

[56] References Cited

UNITED STATES PATENTS

| | | | |
|---|---|---|---|
| 2,594,223 | 4/1952 | Santarelli | 239/331 X |
| 3,239,151 | 3/1966 | Boris | 239/333 |
| 3,248,022 | 4/1966 | Schulman et al. | 239/333 X |
| 3,779,464 | 12/1973 | Malone | 222/321 X |

*Primary Examiner*—John J. Love
*Attorney, Agent, or Firm*—Eyre, Mann & Lucas

[57] ABSTRACT

An atomiser having a tapered pump chamber in which a valved lipped piston is slidably mounted, the piston being compressed radially inwardly by the tapered pump chamber to ensure a tight seal between the valve and its valve seat.

4 Claims, 1 Drawing Figure

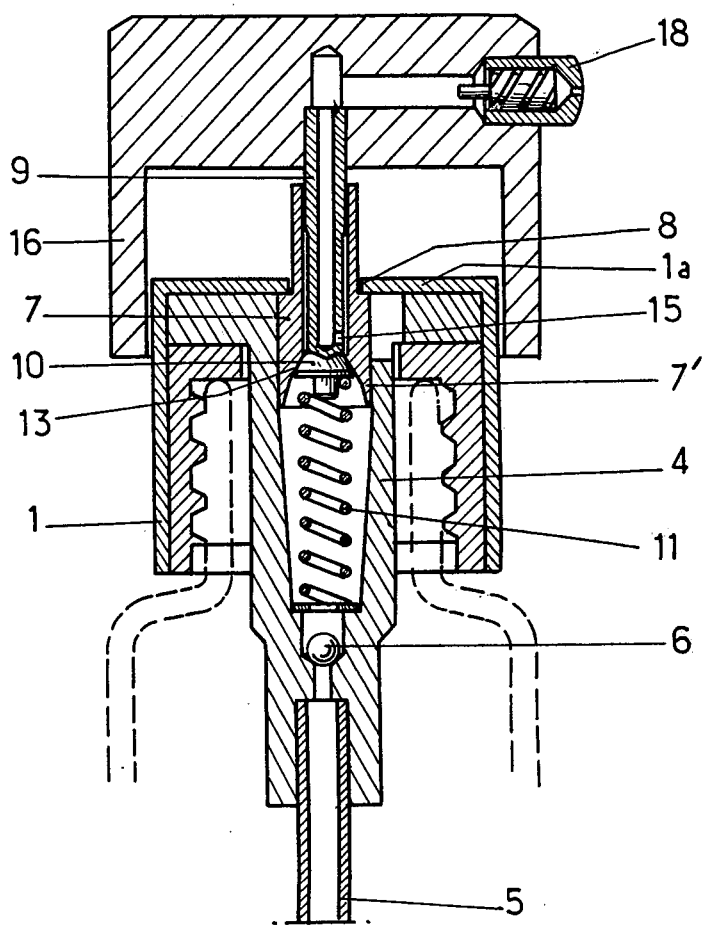
18
9
16
8
1a
7
15
10
7′
13
4
1
11
6
5

ATOMISER HAVING A PLUNGER TUBE

BACKGROUND OF THE INVENTION

U.S. Pat. No. 3,239,151, the disclosure of which is incorporated herein by reference, teaches the construction of an atomiser with plunger tube, which is completely leak-proof in the normal position and contains two sealing members operatively connected to the same control element, one inserted between the plunger tube and the spray nozzle and the other on a free air passage of the container holding the liquid to be sprayed, elastic means urging those elements toward their blocking position.

In an embodiment particularly shown in FIGS. 2–3 of the aforementioned patent, this atomiser contains a pump chamber connected to the plunger tube by means of a check valve, a piston slidably mounted in that chamber, a tube slidably mounted in that piston and operatively connected to the latter so that, when the tube is moved axially, it drives the piston, a control button carrying a nozzle connecting with the tube and capable of moving the latter when the button is pressed, a valve carried on the end of the tube opposite the button and capable of being applied in proximity to said end at least one hole opening inside the piston, and a spring which is inserted between the valve and the bottom of the chamber and tends, on the one hand, to apply the valve on its seat and, on the other, to bring the piston into a rest position in which it blocks a free air opening of the container holding the liquid to be sprayed.

To use that atomiser, the tube is moved against the action of the spring by means of the button. The valve is separated from its seat, which connects the pump chamber with the nozzle; the piston is driven so that the liquid in the chamber is delivered to the nozzle to ensure spraying.

The piston initially slides with firm friction in the pump chamber. However, with time, the lip of the piston creeps due to the effect of the permanent stress applied to it; the friction between that lip and the pump chamber diminishes, resulting in a deterioration of spraying.

This addition concerns an improvement introduced in the atomiser according to the aforementioned patent, with a view to overcoming that disadvantage.

SUMMARY OF THE INVENTION

According to this invention, the pump chamber is shaped like a truncated cone, with its small base being situated at the end from which the plunger tube emerges. The conicity of the pump chamber preferably ranges between 30′ and 3°.

BRIEF DESCRIPTION OF THE DRAWING

An embodiment of the improved atomiser according to the present invention is described below, by way of nonlimitative example, with reference to the single FIGURE of the attached drawing, which is a view in axial section of that atomiser.

DETAILED DESCRIPTION OF THE PREFERRED EMBODIMENT

In the drawing, one finds pump chamber 4, which is connected to plunger tube 5 by means of check valve 6 and in which piston 7 is slidably mounted. Tube 9 is slidably mounted in that piston with a certain longitudinal play and carries at its inner end valve 10, which is urged against the seat 13 machined at the end of piston 7. The piston lip 7′ is of decreasing cross-section as it extends from valve seat 13 to its free end, thus facilitating radial compression by tapered pump chamber 4 on the downstroke. Tube 9 carries, in proximity to valve 10, openings 15 intended to connect pump chamber 4 with tube 9. A spring 11 inserted between valve 10 and the bottom of chamber 4 tends to seal the valve against its seat. Tube 9 is attached to button 16 carrying spray nozzle 18.

At rest, spring 11 urges valve 10 against its seat 13, which interrupts the connection of pump chamber 4 with the outside. In addition, the force exerted by spring 11 on the valve is transmitted by the latter to sleeve 7 so that the latter is applied against the bottom **1*a* of body 1, air thereby being prevented from entering inside the body through opening 8**.

According to this invention, pump chamber 4 has an internal conicity, which is in the order of 1°10′ here, its small base being situated at the end into which plunger tube 5 emerges.

When piston 7 is driven into chamber 4, as a result of the pressure which has been exerted on button 16, its lip 7′ is compressed radially inwardly. The result is, at the beginning of the suction stroke, an increase of friction of that lip against the wall of chamber 4 and an improvement of the contact between valve 10 and its seat 13, which is established when button 16 is released. The suction of the liquid into chamber 4 and its delivery from that chamber to nozzle 18 are reliably ensured.

The advantages of the present invention, as well as certain changes and modifications of the disclosed embodiment thereof, will be readily apparent to those skilled in the art. It is the applicant's intention to cover all those changes and modifications which could be made to the embodiment of the invention herein chosen for the purposes of the disclosure without departing from the spirit and scope of the invention.

What is claimed is:

1. In an atomiser comprising a plunger tube, a pump chamber connected to the plunger tube by means of a check valve, a piston having a lip slidably mounted in that chamber, a tube slidably mounted in that piston and operatively connected to the latter so that, when the tube is moved axially, it drives the piston, a control button carrying a nozzle connecting with the tube and capable of moving the latter when the button is pressed, a valve carried on the end of the tube opposite the button and capable of being applied on a seat at the lip end of the piston, the tube containing in proximity to said lip end at least one hole opening inside the piston, and a spring which is inserted between the valve and the bottom of the chamber and tends to apply the valve on its seat and, to bring the piston into a rest position in which it blocks a free air opening of the container holding the liquid to be sprayed, the improvement comprising: the pump chamber being of the shape of a truncated cone the surface of which is plane, the lip of the piston being of decreasing crosssection as it extends from the valve seat to the free end of the piston, the free end being situated at the larger base of the pump chamber in its rest position said free end having an outside diameter no less than the inside diameter of the larger base of the pump chamber and the free end being radially compressed by the pump chamber as it is moved axially into the pump chamber.

2. The improvement according to claim 1, wherein the conicity of said pump chamber ranges between 30′ and 3°.

3. The improvement according to claim 1, wherein the conicity of said pump chamber is 1°10′.

4. The improvement according to claim 1, wherein said piston has a lip bearing against the wall of said pump chamber, said lip having a decreasing cross-section as it extends from said piston to its free end.

* * * * *